United States Patent [19]

Burnette

[11] 3,997,091

[45] Dec. 14, 1976

[54] HOSIERY DISPLAY APPARATUS

[75] Inventor: Phillip L. Burnette, High Point, N.C.

[73] Assignee: Fleming-Potter Company, Inc., Peoria, Ill.

[22] Filed: Oct. 24, 1975

[21] Appl. No.: 625,571

[52] U.S. Cl. ..... 223/87; 248/309 R

[51] Int. Cl.[2] ..... A41D 27/22

[58] Field of Search ..... 223/87, DIG. 1, DIG. 2; 24/DIG. 11; 211/13; 248/309 R, 359, 360

[56] References Cited

UNITED STATES PATENTS

| | | | |
|---|---|---|---|
| 1,651,172 | 11/1927 | Youngblood | 24/DIG. 11 |
| 1,891,624 | 12/1932 | Graff | 24/DIG. 11 |
| 3,085,725 | 4/1963 | Caparosa | 223/DIG. 1 |
| 3,329,386 | 7/1967 | Rosen | 223/87 UX |
| 3,430,300 | 3/1969 | Doan | 24/DIG. 11 |
| 3,458,093 | 7/1969 | Bacharach | 223/87 |
| 3,790,045 | 2/1974 | Rigel | 223/87 |

FOREIGN PATENTS OR APPLICATIONS

| | | | |
|---|---|---|---|
| 1,222,514 | 2/1971 | United Kingdom | 223/87 |

*Primary Examiner*—William H. Schultz
*Attorney, Agent, or Firm*—Allegretti, Newitt, Witcoff & McAndrews

[57] ABSTRACT

An improved hosiery holder made from cardboard includes an elongated horizontal slot for receipt of the hosiery. One side of the slot is open for sliding the hosiery therein. Adhesive tape, staples or clips close the open side of the slot and hold the hosiery in position. An extension of the adhesive tape, staple or clip attaches to the hosiery to securely hold the hosiery in the slot.

2 Claims, 4 Drawing Figures

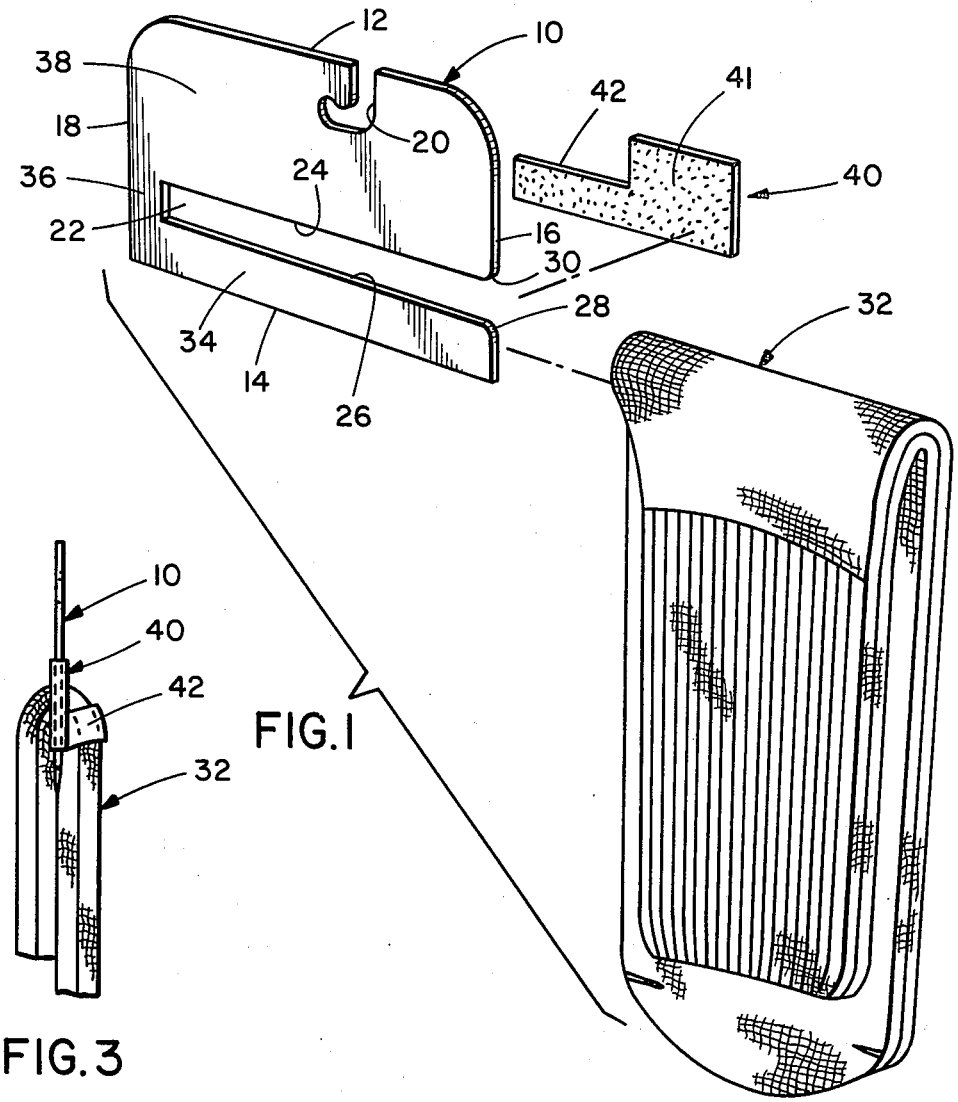
FIG. 1
FIG. 3
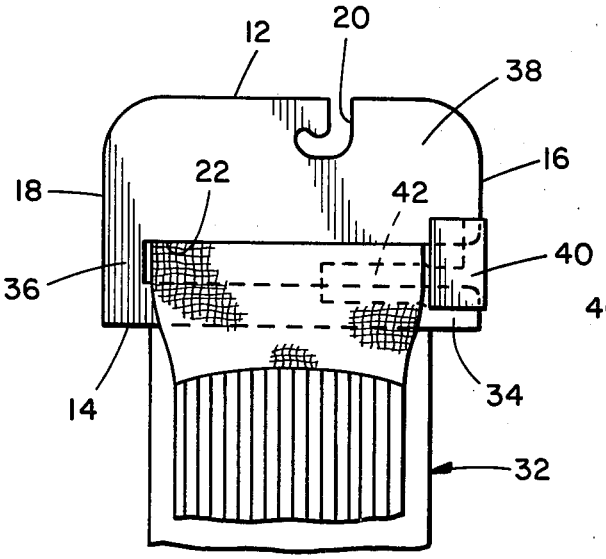
FIG. 2
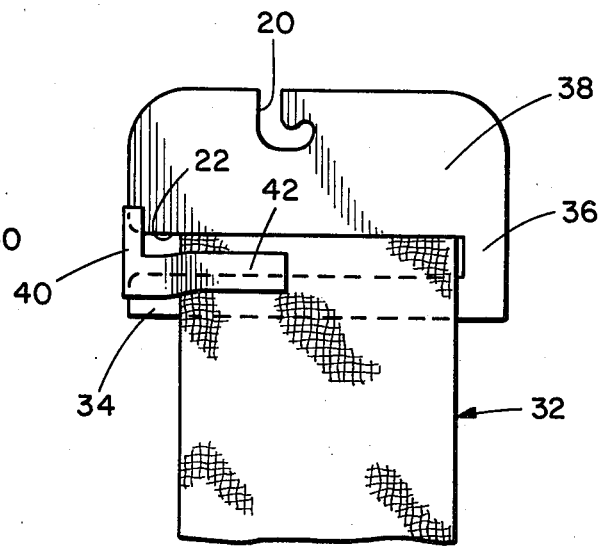
FIG. 4

HOSIERY DISPLAY APPARATUS

BACKGROUND OF THE INVENTION

The present invention relates to an improved hosiery holder. Marketing of hosiery and similar items of apparel is implemented by various display apparatus. For example, hosiery may be placed for display purposes in a glass case. Alternatively, hosiery may be positioned on display racks by means of hosiery hangers.

Typically, hosiery hangers are formed from a molded plastic and include a projecting arm upon which the hosiery item is placed. The arm is connected to a hook for suspending the hosiery from the display rack.

While prior art hosiery display devices are adequate for the display function, various disadvantages occur. For example, display cases do not facilitate self-service merchandising. On the other hand, plastic hooks facilitate self-service, but they are costly. To overcome these disadvantages and provide an improved product, the subject matter of the present invention was devised.

SUMMARY OF THE INVENTION

In a principal aspect, the improved hosiery holder device of the present invention comprises a planar cardboard holder member including hook means at the top edge of the member and a horizontal slot extending from one side of the member partially therethrough toward the opposite side for receipt of a hosiery item. A tape member is attached over the open slot to hold the hosiery in position. An optional extension of the tape member, staples or clips attaches to the hosiery to more securely hold the hosiery in the slot.

Thus, it is an object of the present invention to provide improved hosiery holder device which securely holds hosiery or similar materials in position.

Another object of the present invention is to provide a hosiery holder of more economic construction than prior art hosiery holders.

One further object of the present invention is to provide a hosiery holder comprised of two parts, a cardboard holder member and a tape member, staple or clip for cooperation with the holder member as well as with the hosiery item.

Still a further object of the present invention is to provide a hosiery holder which is disposable, yet sufficiently sturdy for maintaining hosiery items properly supported in a display.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is an exploded perspective view of the improved assembly in combination with hosiery;

FIG. 2 is a front plan view of the improved assembly;

FIG. 3 is a side view of the improved assembly; and

FIG. 4 is a back plan view of the improved assembly.

DESCRIPTION OF THE PREFERRED EMBODIMENT

Referring to the Figures, the holder device 10 is preferably fabricated from a cardboard material although other planar materials may be used. The device 10 may be die cut from a sheet of cardboard material. Note that the cardboard material may have various decorations or designs imprinted thereon. Alternatively, commercial messages and other information may be printed on device 10. If the device 10 is made of a cardboard material, it is also possible to treat the material with perfume or decorative surface materials in order to provide an additional marketing influence.

The device 10 includes a top edge 12, a bottom edge 14 and opposed side edges 16 and 18. A hook member is formed in the top edge 12. That is, an arcuate slot 20 extends from the top edge toward the bottom edge. The slot 20 thus defines a hook which may be attached over a hanger or rod for support of the device 10 and hosiery 32.

An elongated horizontal slot 22 extends from side edge 16 towards side edge 18. Elongated slot 22 is defined by upper slot side 24 and lower slot side 26. Sides 24, 26 are spaced from each other approximately ¼ to ½ inch depending upon the thickness of the hosiery which is inserted in the slot 22. The sides 24 and 26 join with side 16 by means of rounded corners 28 and 30. Rounded corners 28 and 30 facilitate insertion of hosiery 32 into slot 22. Thus, slot 22 is defined by the holder device 10 and more properly by a lower projecting arm 34 joined by a web 36 to the main section 38 of holder device 10.

Hosiery 32 is fitted through the slot 22 with portions of the hosiery 32 overlying the arm 34. A tape member 40 having adhesive 41 on one surface thereof connects the sides 24 and 26 at the edge 16. Thus, the hosiery 32 is surrounded on all sides by either the holder device 10 or the tape member 40. Tape member 40 may be decorated on the adhesive-free surface. Importantly, however, the tape member 40 provides an adhesive connection between arm 34 and main section 38. Preferably, the tape member 41 includes portions adhered to opposed planar surfaces of the device 10. In other words, the tape member 40 wraps around the side edge 16.

A tape member extension 42, which is also adhesive backed, is attached to hosiery 32. In this manner, the hosiery 32 is prevented from slipping out of slot 22. Preferably, the extension 42 includes a portion which attaches to the main section 38 or arm 34 as well as the hosiery 32. This provides a more complete attachment and holding of the hosiery 32.

The above description relates to a preferred embodiment of the invention. The preferred configuration is described and illustrated in the drawing. However, alternative configurations and modifications are possible within the scope of the invention. For example, the hook member may project from the top edge 12. The elongated slot 22 may be of an arcuate shape, rather than a straight line shape. The total shape of the main section may be varied. The opening or slot 22 may be closed by a staple, clip or the like rather than tape 40. Therefore, the subject matter of the invention is to be limited only by the following claims and their equivalents.

What is claimed is:

1. An improved hosiery holder device comprising, in combination:

a planar holder member including a top edge, a bottom edge, and opposed side edges, a hook member formed at the top edge and a slot extending through one side edge toward the other side edge, and substantially parallel to the bottom edge to define a lower arm for receipt of a hosiery item, said lower arm being spaced from a main section of the holder, the open end of the slot having opposed rounded corners to facilitate receipt of hosiery in the slot; and a flexible tape member attached to the holder member over the opposed rounded corners of the open slot for holding the hosiery item in the slot, said tape member having adhesive material on one side thereof with the adhesive surface folded over opposed sides of the planar holder member, and including an extension which projects over at least a portion of the remainder of the slot and adheres to hosiery in the slot to retain the hosiery in a substantially fixed, non-slip position.

2. The improved device of claim 1 wherein said hook is comprised of an arcuate slot extending downward from the top edge of said holder member into said member.

* * * * *